United States Patent [19]

Sakurai et al.

[11] Patent Number: 5,034,661

[45] Date of Patent: Jul. 23, 1991

[54] RARE GAS DISCHARGE FLUORESCENT LAMP DEVICE

[75] Inventors: Takehiko Sakurai; Takeo Saikatsu; Yoshinori Anazi; Hiroyoshi Yamazaki; Katsuo Murakami; Seishiro Mitsuhashi; Takashi Ohsawa, all of Kanagawa, Japan

[73] Assignee: Mitsubishi Denki Kabushiki Kaisha, Tokyo, Japan

[21] Appl. No.: 453,828

[22] Filed: Dec. 20, 1989

[30] Foreign Application Priority Data

Dec. 27, 1988 [JP] Japan ..... 63-330439
Dec. 27, 1988 [JP] Japan ..... 63-330440
Dec. 27, 1988 [JP] Japan ..... 63-330441

[51] Int. Cl.[5] ..... H05B 41/14

[52] U.S. Cl. ..... 315/207; 315/209 R; 315/326; 315/358; 315/DIG. 5; 313/572; 313/641

[58] Field of Search ..... 315/200 R, 207, 209 R, 315/283, 326, 358, DIG. 5; 313/572, 573, 576, 641, 642

[56] References Cited

U.S. PATENT DOCUMENTS 3,745,411 7/1973 Polman et al. ..... 315/209 R
4,899,090 2/1990 Yoshiike et al. ..... 313/607 X

FOREIGN PATENT DOCUMENTS 63-58752 3/1988 Japan .
63-29931 6/1988 Japan .
63-248050 10/1988 Japan .

*Primary Examiner*—David Mis
*Attorney, Agent, or Firm*—Burns, Doane, Swecker & Mathis

[57] ABSTRACT

The invention provides a rare gas discharge fluorescent lamp device which is long in life and high in brightness and efficiency. The lamp device comprises a rare gas discharge fluorescent lamp including a bulb having rare gas such as xenon, argon or krypton gas enclosed therein, a fluorescent layer formed on an inner face of the bulb, a reflecting film formed on an inner face of the fluorescent layer, and a pair of electrodes located at the opposite ends of the bulb. The lamp device further comprises a power source for applying a voltage across the electrodes, and pulse voltage forming means connected between the electrodes and the power source for forming a dc pulse voltage from a voltage supplied from the power source. The dc pulse voltage thus formed is applied across the electrodes to cause the lamp to be lit. The pulse frequency of the pulse voltage and the enclosed gas pressure are determined depending upon the rare gas employed, and particularly where dc rectangular pulses are used, the duty ratio is also determined depending upon the rare gas employed.

10 Claims, 18 Drawing Sheets

RARE GAS DISCHARGE FLUORESCENT LAMP DEVICE

BACKGROUND OF THE INVENTION

1. Field of the Invention

This invention relates to a rare gas discharge fluorescent lamp for use with an information device such as a facsimile, a copying machine or an image reader wherein fluorescent substance is excited to emit light by ultraviolet rays generated by rare gas discharge.

2. Description of the Prior Art

In recent years, the performances of information terminal devices such as a facsimile, a copying machine and an image reader have been improved together with advancement of the information-oriented society, and the market of such information devices is rapidly expanding. In developing information devices of a higher performance, a light source unit for use with such information devices is required to have a higher performance as a key device thereof. Conventionally, halogen lamps and fluorescent lamps have been employed frequently as lamps for use with such light source units. However, since halogen lamps are comparatively low in efficiency, fluorescent lamps which are higher in efficiency are used principally in recent years.

However, while a fluorescent lamp is high in efficiency, it has a problem that characteristics thereof such as the fact that an optical output characteristic varies in accordance with a temperature since discharge from mercury vapor is utilized for emission of light. Therefore, when a fluorescent substance is used, either the temperature range in use is limited, or a heater is provided on a wall of a tube of the lamp in order to control the temperature of the lamp. However, development of fluorescent lamps having stabilized characteristics are demanded eagerly for diversification of locations for use and for improvement in performance of devices. From such background, a rare gas discharge fluorescent lamp which makes use of emission of light based on rare gas discharge and is free from a change in temperature characteristic is being developed as a light source for an information device.

FIGS. 19 and 20 show an exemplary conventional rare gas discharge fluorescent lamp devices which is disclosed, for example, in Japanese Patent Laid-Open No. 63-58752, and wherein FIG. 19 is a diagrammatic representation showing a longitudinal section of a rare gas discharge fluorescent lamp and an entire construction of the device, and FIG. 20 is a cross sectional view of the lamp. Referring to FIGS. 19 and 20, the rare gas discharge fluorescent lamp of the device shown includes a bulb 1 in the form of an elongated hollow rod or tube which may be made of quartz or hard or soft glass. A fluorescent coating 2 is formed on an inner face of the bulb 1, and rare gas consisting at least one of xenon, krypton, argon, neon and helium gas is enclosed in the bulb 1. A pair of inner electrodes 3*a* and 3*b* having polarities opposite to each other are located at the opposite longitudinal end portions within the bulb 1. The inner electrodes 3*a* and 3*b* are individually connected to a pair of lead wires 4 which extend in an airtight condition through the opposite end walls of the bulb 1. An outer electrode 5 in the form of a belt is provided on an outer face of a side wall of the bulb 1 and extends in parallel to the axis of the bulb 1.

The inner electrodes 3*a* and 3*b* are connected by way of the lead wires 4 to a high frequency invertor 6 serving as a high frequency power generating device, and the high frequency invertor 6 is connected to a dc power source 7. The outer electrode 5 is connected to the high frequency invertor 6 such that it may have the same polarity as the inner electrode 3*a*.

Operation of the rare gas discharge fluorescent lamp device is described subsequently. With the rare gas discharge fluorescent lamp device having such a construction as described above, if a high frequency power is applied across the inner electrodes 3*a* and 3*b* by way of the high frequency invertor 6, then glow discharge will take place between the inner electrodes 3*a* and 3*b*. The glow discharge will excite the rare gas within the bulb 1 so that the rare gas will emit peculiar ultraviolet rays therefrom. The ultraviolet rays will excite the fluorescent coating 2 formed on the inner face of the bulb 1. Consequently, visible rays of light are emitted from the fluorescent coating 2 and discharged to the outside of the bulb 1.

Another rare gas discharge fluorescent lamp is disclosed, for example, in Japanese Patent Laid-Open No. 63-248050. The lamp employs such a hot cathode electrode as disclosed, for example, in Japanese Patent Publication No. 63-29931 in order to eliminate the drawback of a cold cathode rare gas discharge lamp that the starting voltage is comparatively high. The rare gas discharge fluorescent lamp can provide a comparatively high output power because its power load can be increased. However, it can attain only a considerably low efficiency and optical output as compared with a fluorescent lamp based on mercury vapor.

In summary, conventional rare gas discharge fluorescent lamps cannot attain a sufficiently high brightness or efficiency as compared with fluorescent lamps employing mercury vapor because fluorescent substance is excited to emit light by ultraviolet rays generated by rare gas discharge.

SUMMARY OF THE INVENTION

The present invention has been made to eliminate such problems as described above, and it is an object of the present invention to provide a rare gas discharge fluorescent lamp device wherein a rare gas discharge fluorescent lamp can be lit in a high brightness and in a high efficiency.

In a rare gas discharge fluorescent lamp device according to the present invention, a pulse-like voltage is applied across a glass bulb so that the probability wherein molecules of gas which is enclosed in the bulb and contributes to emission of light may be excited at such an energy level that a great amount of ultraviolet rays of the gas may be produced by resonance in order that the lamp may increase emission of light and improve the efficiency and may restrain wear of electrodes. To this end, pulse-like or intermittent discharge which involves die periods of lamp current is caused in the lamp by a half-wave rectified voltage supply from a lighting device having a simple construction wherein a current limiting element and a diode are added to a conventional high frequency power source, and a voltage is supplied across the lamp at a suitable frequency depending upon a balance between an energization period and the idle period of the pulse-like discharge. Or else. a dc power source is provided in place of such conventional high frequency power source, and a dc voltage supplied from the dc power source is switched on and off by means of a switching element such as an FET (field effect transistor) to form dc rectangular pulses to be applied to the lamp. Then, the rate of an energization period with respect to a period of such pulses, the frequency of the pulses, the amount of gas to be enclosed in the lamp, and so forth, are suitably set.

A lighting device where, for example, a half-wave rectified voltage is utilized as described above is constituted from a series circuit of a high frequency power source and a current limiting element, and a diode connected in parallel to the series circuit, and either a half-wave rectified voltage having a frequency higher than 4 KHz but lower than 200 KHz is supplied across the lamp in which xenon gas is enclosed at a pressure higher than 10 Torr but lower than 200 Torr in order to cause the lamp to be lit, or a half-wave rectified voltage having a frequency higher than 5 KHz but lower than 200 KHz is supplied across the lamp in which krypton gas is enclosed at a pressure higher than 10 Torr but lower than 100 Torr in order to cause the lamp to be lit. Under the construction conditions described above, pulse-like discharge which involves die periods of lamp current takes place in the lamp, and a voltage is applied across the lamp at a suitable frequency depending upon the energization period, and besides xenon gas or krypton gas is enclosed in the lamp at such a pressure that it may be excited in a high efficiency by pulse-like lighting. Accordingly, xenon gas or krypton gas is excited in a high efficiency, and radiation of ultraviolet rays is increased and the lamp efficiency is improved.

On the other hand, in a rare gas discharge fluorescent lamp device wherein the voltage to be applied across the lamp is a dc rectangular wave pulse voltage, argon gas is enclosed in the glass bulb at a pressure higher than 10 Torr but lower than 100 Torr, and a pulse-like voltage wherein the rate of the energization time for one period is higher than 5% but lower than 80% and the energization time is shorter than 150 μsec is applied across the opposite electrodes to cause the rare gas discharge fluorescent lamp to be lit.

Or else, the gas to be enclosed in the glass bulb is changed from argon to krypton, and the rare gas discharge fluorescent lamp is caused to be lit by a voltage wherein the rate of the energization time for one period in the pulse-like application voltage is set to a value higher than 5% but lower than 70%.

Or otherwise where the enclosed gas is further changed to xenon gas, the enclosed gas pressure is set to a value higher than 10 Torr but lower than 200 Torr, and the rare gas discharge fluorescent lamp is caused to be lit by a voltage wherein the rate of the energization time for one period in the pulse-like application voltage is set to a value higher than 5% but lower than 70% similarly as in the case of krypton gas.

Other objects and features of the invention will be more fully understood from the following detailed description and appended claims when taken with the accompanying drawings.

DETAILED DESCRIPTION OF THE PREFERRED EMBODIMENTS

In the following, several embodiments of the present invention are described with reference to the accompanying drawings.

Figure 1:
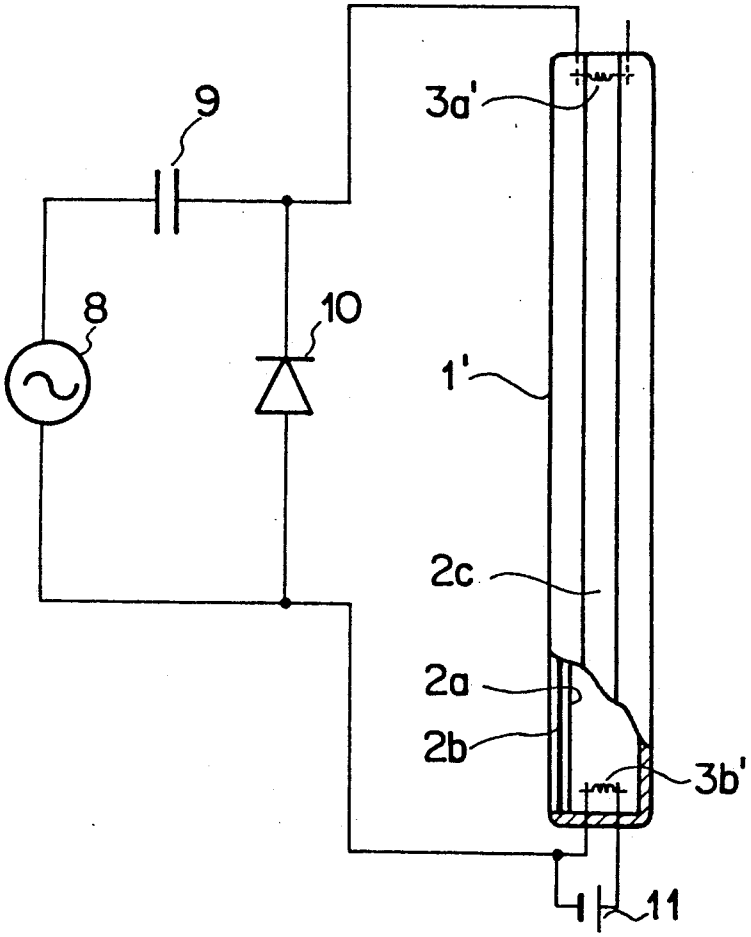
FIG. 1 is a diagrammatic representation of an entire construction of a rare gas discharge fluorescent lamp device showing an embodiment of the present invention wherein a half-wave rectified voltage is utilized.

Referring to FIG. 1, there is shown as an embodiment of the present invention an entire construction of a rare gas discharge fluorescent lamp device which makes use of a half-wave rectified voltage. The lamp device shown includes a rare gas discharge fluorescent lamp which includes a bulb 1' made of glass, a fluorescent layer 2a and a reflecting film 2b both formed on an inner face of the bulb 1'. The fluorescent layer 2a and the reflecting film 2b are not formed at a slit portion 2c on the inner face of the bulb 1'. The lamp further includes a pair of electrodes 3a' and 3b' each formed from a filament coil to which an electron emitting substance is applied. The lamp device includes, in addition to the lamp, a high frequency power source 8, a capacitor 9 connected in series to the high frequency power source 8 and acting as a current limiting element, a diode 10 connected in parallel to the series circuit of the high frequency power source 8 and the capacitor 9, and a power source 11 for heating the electrode 3b'.

Operation of the device is now described. With the rare gas discharge fluorescent lamp device shown in FIG. 1, when a positive voltage is applied to the electrode 3a', the voltage is applied across the bulb 1 ' so that a lamp current flows through the lamp. When a negative voltage is applied to the electrode 3a', however, the lamp is short-circuited by the diode 10, and consequently, no voltage is applied across the bulb 1' and no current flows through the lamp. Accordingly, with the rare gas discharge fluorescent lamp device of the construction described above, a high frequency half-wave rectified voltage is applied across the lamp so that pulse-like discharge wherein the lamp current presents idle periods takes place in the bulb 1', which is different from ordinary high frequency lighting. Here, the capacitor 9 functions as a current limiting element for allowing only an appropriate electric current to flow through the bulb 1' when a high frequency voltage is applied.

Figure 2:
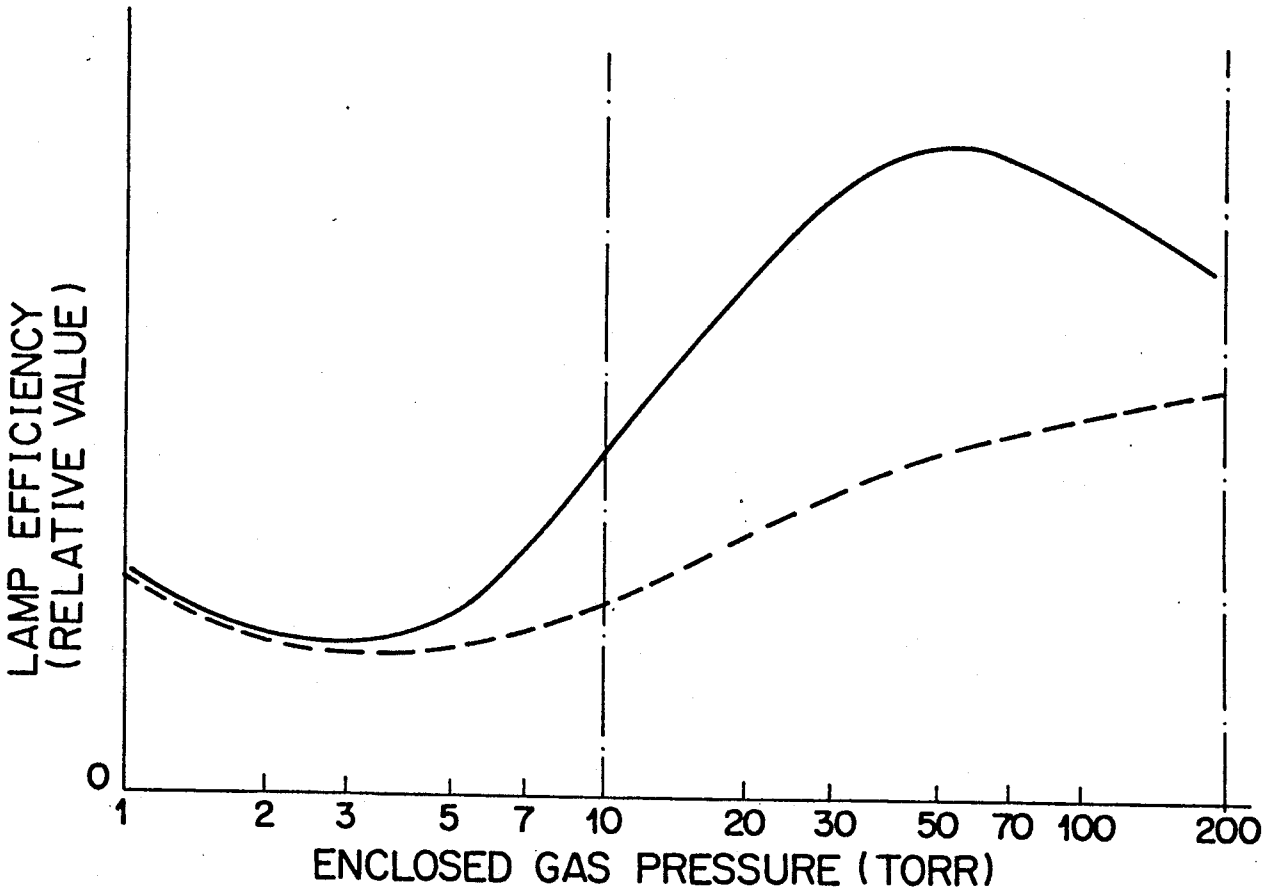
FIG. 2 is a diagram showing a relationship between an enclosed gas pressure and a lamp efficiency when xenon gas is used with the device shown in FIG. 1.

FIG. 2 shows a relationship between a pressure of enclosed gas and an efficiency of the lamp when xenon gas is enclosed in the rare gas discharge fluorescent lamp shown in FIG. 1. Here, the bulb 1' of the lamp has an outer diameter of 15.5 mm and an overall length of 300 mm, and the lamp power is constant at 7 W and the frequency is 20 KHz. In FIG. 2, a solid line curve indicates the relationship when the lamp device of the construction shown in FIG. 1 is lit in a pulse-like fashion while a broken line curve indicates the relationship in the case of high frequency lighting by an ordinary ac sine wave. It can be seen from FIG. 2 that the lamp device of the embodiment of the present invention shown in FIG. 1 presents an effect of improvement in lamp efficiency and such effect of improvement in lamp efficiency depends upon a pressure of enclosed xenon gas. Also it can be seen from FIG. 2 that a maximum efficiency is obtained where the enclosed xenon gas pressure is within a region of several tens Torr and that the significant effect of improvement in efficiency by the present invention as compared with that in ordinary high frequency lighting can be obtained within a range of the enclosed xenon gas pressure between 10 Torr to 200 Torr. Such improvement in lamp efficiency arises from the fact that pulse-like discharge wherein an energization period and idle period alternatively appear modulates electron energy of a positive column to a high degree to increase the energy to excite the xenon gas so as to increase ultraviolet rays to be generated from the xenon gas, and also from emission of after glow light during such idle periods. For example, the value of 10 Torr at which the lamp efficiency presents significant improvement corresponds to a pressure at which emission of after glow light during idle periods, which hardly appears at several Torr, appears significantly. By the way, the improvement in efficiency is comparatively low at a high pressure, but this phenomenon arises from the fact that, if the pressure is excessively high, then the electron energy is restrained by frequent collisions of electrons with xenon gas, and consequently, the electron energy is not modulated readily by pulses.

Figure 3:
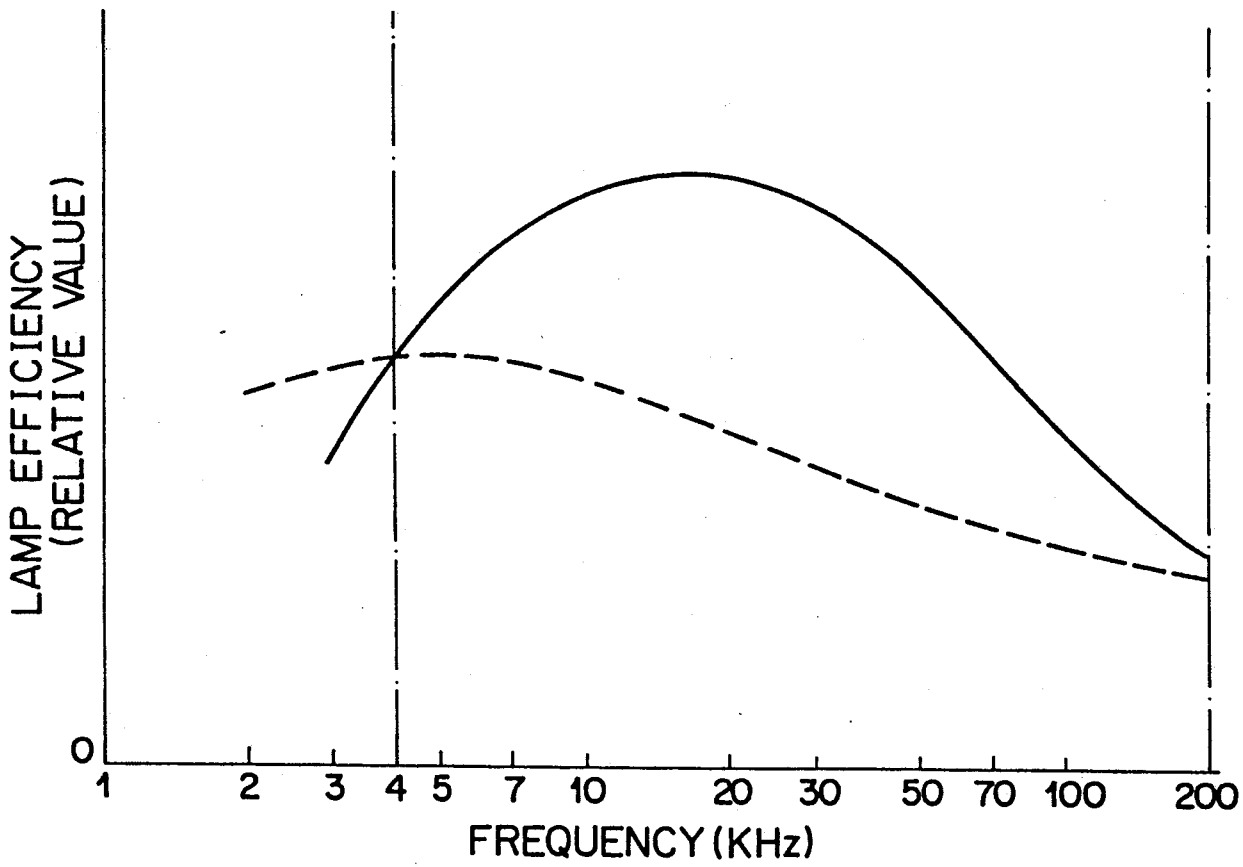
FIG. 3 is a diagram showing a relationship between a lighting frequency and a lamp efficiency when xenon gas is used with the device shown in FIG. 1.

FIG. 3 shows a relationship between a lighting frequency and a lamp efficiency. In FIG. 3, a solid line curve indicates the relationship when the lamp device of the construction shown in FIG. 1 is lit by pulses, while a broken line curve indicates the relationship in the case of ordinary high frequency lighting. Here, the rare gas discharge fluorescent lamp encloses xenon gas at 30 Torr therein, and the lamp power is constant at 7 W.

From FIG. 3, it can be seen that a high efficiency is obtained at a frequency higher than 4 KHz with the rare gas discharge fluorescent lamp device of the embodiment of the present invention shown in FIG. 1 as compared with that in ordinary high frequency lighting. It can also be seen that, if the frequency rises to about 200 KHz, the efficiencies in the two cases present substantially same levels. Accordingly, the frequency should be higher than 4 KHz but lower than 200 KHz.

It is to be noted that the reason why the efficiency drops at the high frequency and becomes substantially equal to that in the case of ordinary high frequency lighting is that a plasma parameter of a positive column cannot follow such high frequency and gradually approaches a fixed condition similar to a dc current.

In this manner, with the rare gas discharge fluorescent lamp device having such a construction as shown in FIG. 1, the lamp efficiency can be improved significantly and the lighting device is so simplified in construction that it can be realized readily at a reduced cost. Further, since a capacitor is employed as the current limiting element, the power loss of the lighting device is low. Besides, since a voltage equal to twice as much as that of the power source is generated by the combination of the diode and the capacitor, a high voltage required for starting of discharge can be obtained readily. In addition, since the discharge current can have a waveform which has a moderate rising feature in the form of a half-wave rectified sine wave, there is an effect that higher harmonic wave components are reduced and electromagnetic noises which make a problem in pulse discharge are also reduced.

It is to be noted that, while the lamp in the embodiment described above has an outer diameter of 15.5 mm as an example, an examination which was conducted with lamps having outer diameters ranging from 8 mm to 15.5 mm revealed that such improvement in efficiency as described above is obtained with the construction shown in FIG. 1 irrespective of the outer diameters of the lamps. Further, while one of the filament coils in the embodiment described above is of the hot cathode type, since the improvement in efficiency arises from the improvement in efficiency of a positive column, it may otherwise be, for example, of the cold cathode type without depending upon the electrode structure. However, where a filament coil electrode is employed as in the embodiment described above, it is effective for reduction of a starting voltage and increase in life of an electrode to heat the cathode as seen in FIG. 1.

Further, since xenon gas is lowest in ionization potential and excitation potential among rare gases, even if some other rare gas or gases are mixed with xenon as enclosed gas, emission of light by xenon can be obtained similarly.

Figure 6:
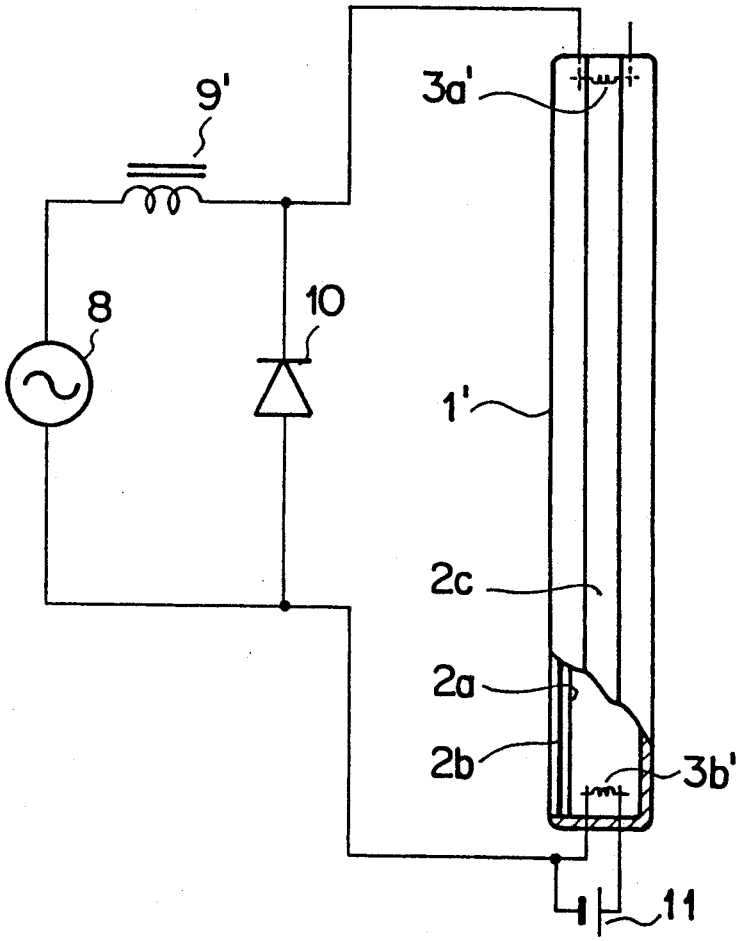
FIG. 6 is a diagrammatic representation of an entire construction of a rare gas discharge fluorescent lamp device showing another embodiment of the present invention wherein a half-wave rectified voltage is utilized.

Further, while a capacitor is employed as the current limiting element in the embodiment described above, the current limiting element may otherwise be constituted from an inductor as shown in FIG. 6 in which another embodiment of the present invention is shown.

Also with the rare gas discharge fluorescent lamp device shown in FIG. 6, a lighting device is obtained which is low in power loss and inexpensive. Also with the rare gas discharge fluorescent lamp device where the current limiting element was constituted from an inductor in this manner, similar characteristics to those such lamp efficiency characteristics with respect to an enclosed gas pressure or a frequency as shown in FIGS. 2 and 3 which were obtained from the rare gas discharge fluorescent lamp device of the construction shown in FIG. 1 were obtained.

Figure 4:
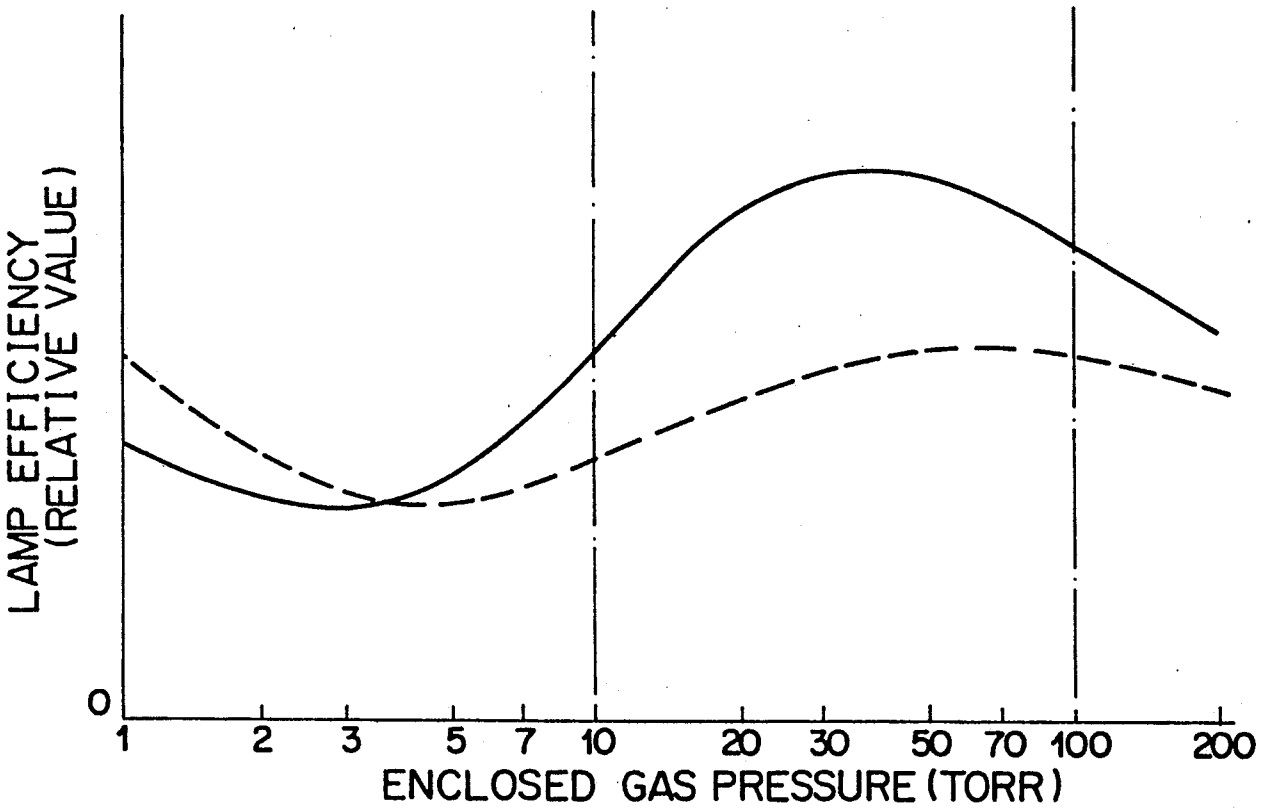
FIG. 4 is a diagram showing a relationship between an enclosed gas pressure and a lamp efficiency when krypton is used with the device shown in FIG. 1.

Subsequently, efficiency characteristics where krypton gas is enclosed in the bulb 1' of the rare gas discharge fluorescent lamp device which makes use of a half-wave rectified voltage will be described. Referring to FIG. 4, there is shown a relationship between an enclosed gas pressure and a lamp efficiency where krypton gas is enclosed in the bulb 1' of the rare gas discharge fluorescent lamp device having such a construction as shown in FIG. 1. It is to be noted that the lamp used has an outer diameter of 15.5 mm and an axial length of 300 mm, and the lamp power is constant at 7 W and frequency is 20 KHz. In FIG. 4, a solid line curve indicates the relationship when the lamp is lit based on pulse-like discharge with the construction shown in FIG. 1 while a broken line curve indicates the relationship in the case of high frequency lighting based on an ordinary ac sine wave.

From FIG. 4, it can be seen that the rare gas discharge fluorescent lamp device of the present embodiment has an effect of improvement in lamp efficiency, and the effect of improvement in lamp efficiency depends upon an enclosed gas pressure of krypton gas. It can be seen also from FIG. 4 that the maximum efficiency is obtained where the enclosed krypton gas pressure is within the range of several tens Torr, and a significant effect of improvement in efficiency of the embodiment with respect to that in ordinary high frequency lighting can be obtained within the range from 10 Torr to 100 Torr. Such improvement in lamp efficiency relies upon a similar action of krypton gas to that of xenon gas described above.

Figure 5:
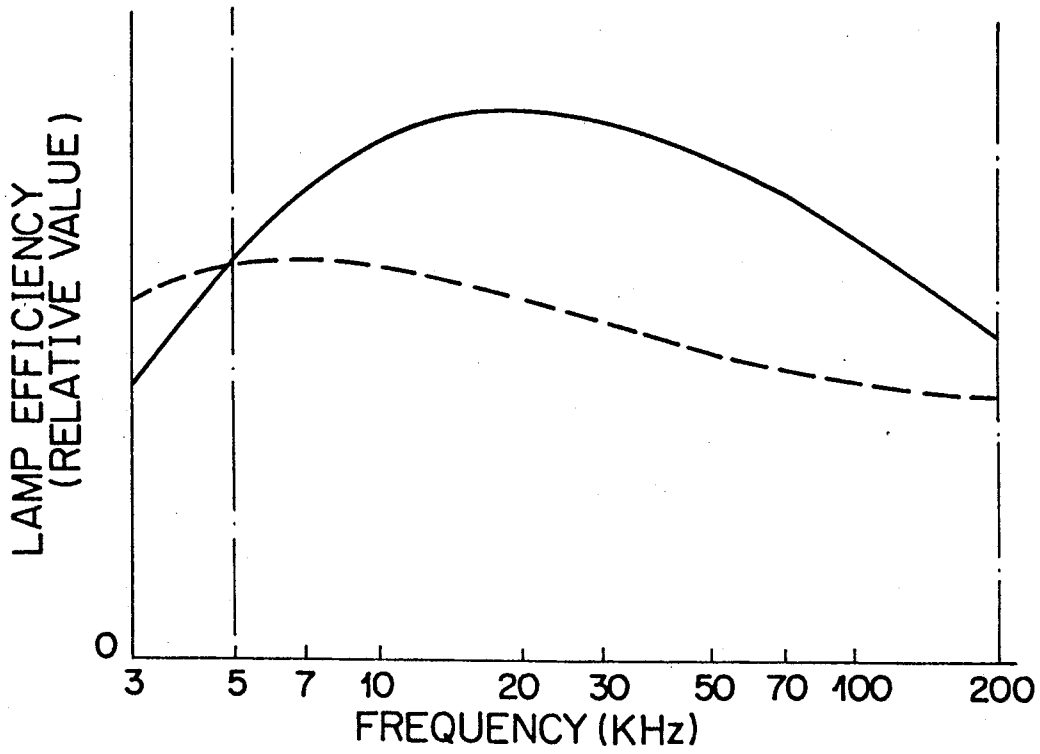
FIG. 5 is a diagram showing a relationship between a lighting frequency and a lamp efficiency when krypton is used with the device shown in FIG. 1.

FIG. 5 shows a relationship between a lighting frequency and a lamp efficiency of the rare gas discharge fluorescent lamp device which employs krypton gas as enclosed gas. Referring to FIG. 5, a solid line curve indicates the relationship when the lamp is lit based on pulse-like discharge while a broken line curve indicates the relationship in the case of ordinary high frequency lighting. It is to be noted that the lamp of the rare gas discharge fluorescent lamp device encloses krypton gas therein at 3.0 Torr, and the lamp power is constant at 7 W. From FIG. 5, the rare gas discharge fluorescent lamp device wherein krypton gas is enclosed in the lamp presents a high efficiency in a frequency range higher than 5 KHz as compared with that in ordinary high frequency lighting. Further, the maximum efficiency is exhibited at a frequency of about 20 KHz, and the efficiency drops at a higher frequency such that it is so low at a frequency of about 200 KHz that it is near to the efficiency in the case of ordinary high frequency lighting.

It is to be noted that such drop of the efficiency in a high frequency region arises from a similar action of krypton gas to that in the case of xenon gas described above.

In this manner, the lamp efficiency can be improved significantly also with the rare gas discharge fluorescent lamp device wherein krypton gas is enclosed in the lamp, and the lighting device can be simplified significantly in construction and can be realized readily at a reduced cost.

Further, since a capacitor is used as the current limiting element, the power loss of the lighting device is low.

The current limiting element may otherwise be constituted from an inductor as shown in FIG. 6 and as described hereinabove. Also where the current limiting element is constituted from an inductor, characteristics similar to such lamp efficiency characteristics with respect to an enclosed gas pressure or a frequency as shown in FIGS. 4 and 5 were obtained.

It is to be noted that while the lamp has an outer diameter of 15.5 mm as an example in the embodiment described above wherein krypton gas is enclosed in the lamp, an examination which was conducted with such lamps that have outer diameters ranging from 8 mm to 15.5 mm revealed that similar improvement in efficiency was obtained irrespective of the diameters of the lamp bulbs. Further, while the filament coil is of the hot cathode type, since the improvement in efficiency depends upon improvement in efficiency of a positive column, the filament coil may otherwise be, for example, of the cold cathode type without depending upon the electrode structure. However, where a filament coil electrode is employed, it is effective for reduction of the starting voltage and increase in life of an electrode to heat the cathode as seen in FIG. 1.

Further, even if argon, neon or helium which have a higher ionization potential than krypton is mixed with krypton for enclosed gas, emission of light can be obtained similarly to that only by krypton gas itself.

While the several embodiments are described so far wherein a half-wave rectified voltage is utilized, various other embodiments of the present invention will be described below wherein a dc rectangular pulse voltage is utilized.

Figure 7:
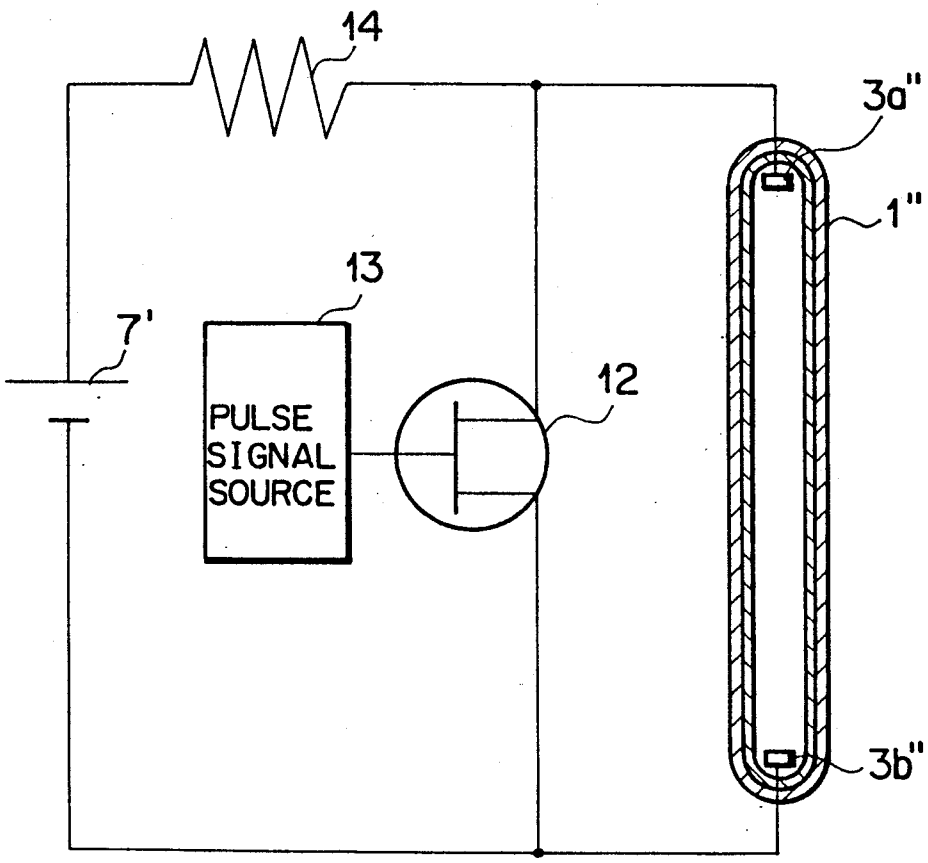
FIG. 7 is a diagrammatic representation of an entire construction of a rare gas discharge fluorescent lamp device showing a further embodiment of the present invention wherein a dc rectangular pulse voltage is utilized.

Referring now to FIG. 7, there is shown a rare gas discharge fluorescent lamp device wherein dc rectangular pulses are utilized. The lamp device shown includes a bulb 1" made of glass and having a straight cylindrical configuration having a diameter of 15.5 mm and an axial length of 300 mm. The bulb 1" has a film of a fluorescent substance formed on an entire inner peripheral surface thereof. A pair of electrodes 3*a*" and 3*b*" are located at the axial opposite ends in the bulb 1". Though not particularly shown, an aluminum plate having a width of 3 mm is secured to and extends along an outer surface of the bulb 1" and serves as an auxiliary starting conductor. The lamp device further includes a dc power source 7' connected to the electrodes 3*a*" and 3*b*" of the rare gas discharge fluorescent lamp for supplying a dc voltage across the electrodes 3*a*" and 3*b*". A switching element 12 such as an FET (Field Effect Transistor) is connected in parallel to the rare gas discharge fluorescent lamp and acts to connect or disconnect a dc voltage to be applied to the lamp. The lamp device further includes a pulse signal source 13 connected to the switching element 12. The switching element 12 thus receives pulses from the pulse signal source 13 and performs switching on and off in accordance with a period and a pulse width of the pulses received to change a voltage to be applied to the bulb 1" into dc rectangular pulses. The lamp is thus lit intermittently by the pulse voltage. The lamp device further includes a resistor 14 serving as a current limiting element.

An examination of measuring a brightness and an efficiency of the rare gas discharge fluorescent lamp device described above with xenon gas, argon gas and krypton gas enclosed individually in the glass bulb 1" was conducted individually changing the pressure of enclosed gas in the lamp, the ratio of an energization time within a period (hereinafter referred to duty ratio), the energization time and so forth in intermitting lighting of the lamp.

Figure 8:
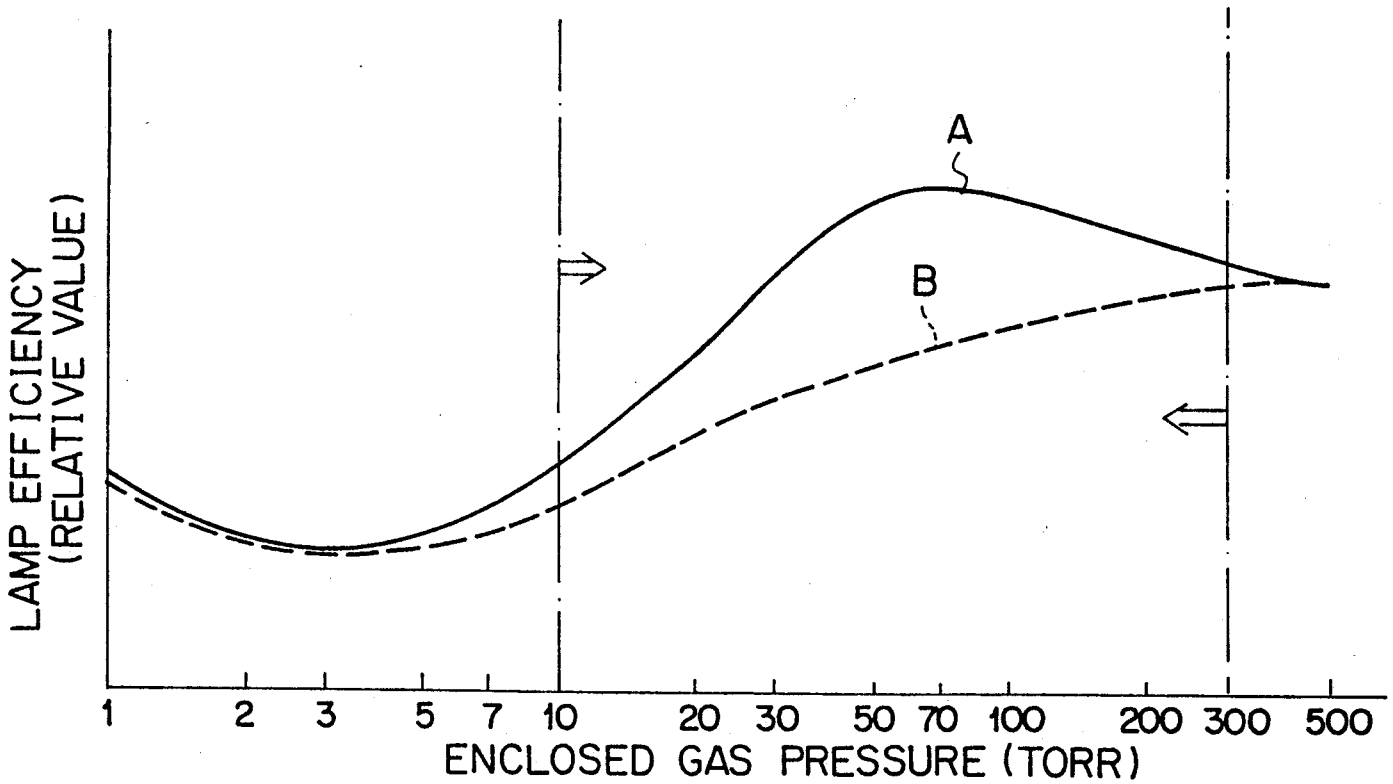
FIG. 8 is a diagram showing a relationship between an enclosed gas pressure and a lamp efficiency when xenon gas is used with the device shown in FIG. 7.
Figure 9:
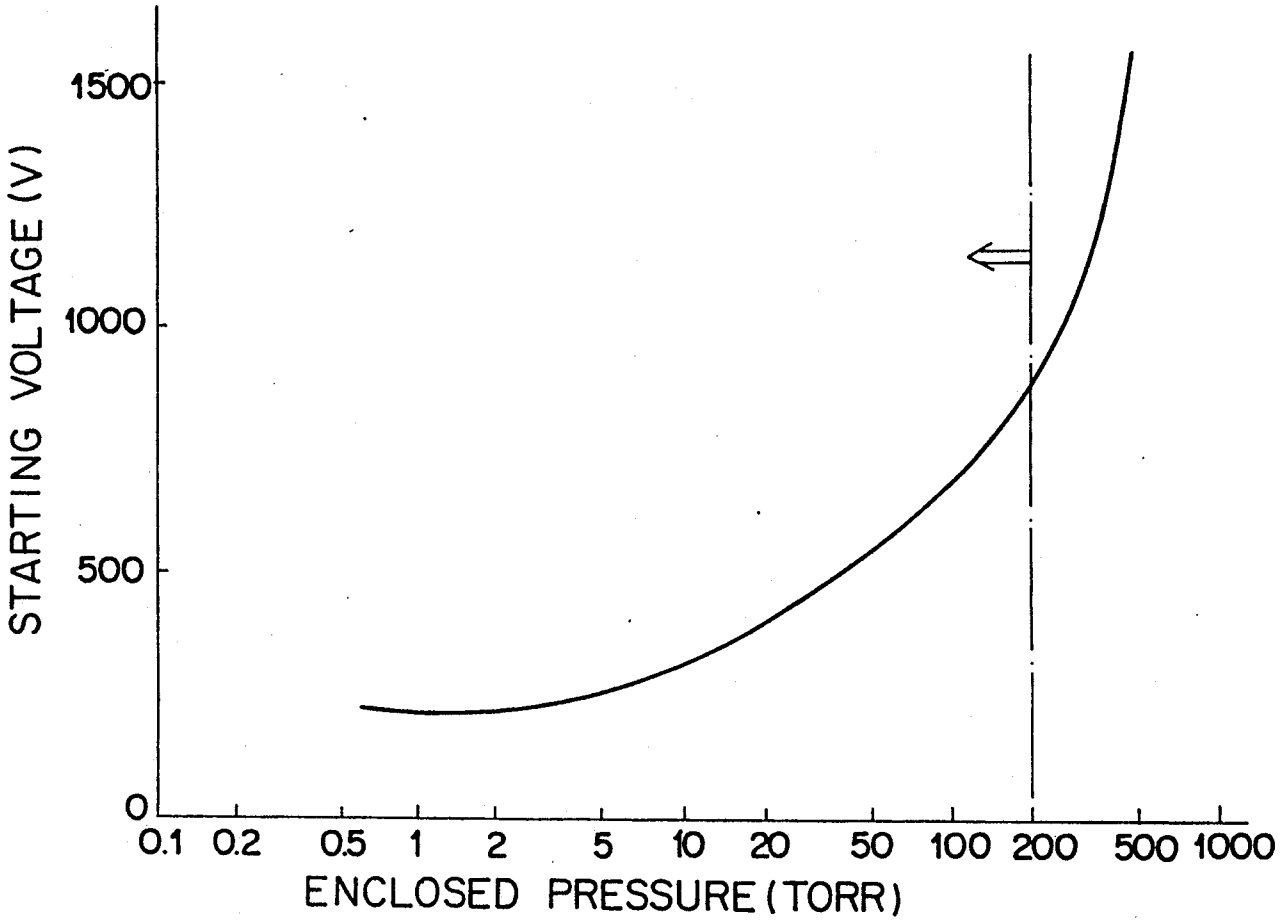
FIG. 9 is a diagram showing a starting voltage characteristic with respect to an enclosed gas pressure when xenon gas is used with the device shown in FIG. 7.

FIG. 8 shows a relationship between a pressure of enclosed xenon gas and a lamp efficiency. It is to be noted that the lamp efficiency is determined from a value obtained by dividing a brightness by an electric power. In FIG. 8, a solid line curve A indicates the relationship when the rare gas discharge fluorescent lamp is lit by rectangular wave dc pulses having a duty ratio of 60% while a broken line curve B indicates the relationship in the case of ordinary high frequency ac lighting (sine wave), and in both cases, the frequency is 20 KHz and the power consumption is the same. It can be seen from FIG. 8 that, at an enclosed gas pressure lower than 10 Torr, there is no significant difference in efficiency between pulse lighting and ac lighting, but at an enclosed gas pressure higher than 10 Torr, the efficiency in pulse lighting is higher than the efficiency in ac lighting. However, if the enclosed gas pressure exceeds about 70 Torr, then the efficiency of the lamp in ac lighting still rises but the efficiency of the lamp in pulse lighting begins to drop, and then at 200 to 300 Torr, the efficiency of the lamp in pulse lighting approaches the value of the efficiency in ac lighting again. On the other hand, FIG. 9 shows a relationship between an enclosed gas pressure and a starting voltage. It can be seen from FIG. 9 that, as the enclosed gas pressure increases, a progressively high voltage becomes necessary for starting. Since such rise of the starting voltage is remarkable particularly at an enclosed gas pressure higher than 200 Torr, preferably the enclosed gas pressure is lower than 200 Torr. Accordingly, from FIGS. 8 and 9, the optimum enclosed gas pressure at which the efficiency is higher than that in high frequency lighting and pulse lighting wherein the starting voltage is practical can be attained is higher than 10 Torr but lower than 200 Torr.

Figure 10:
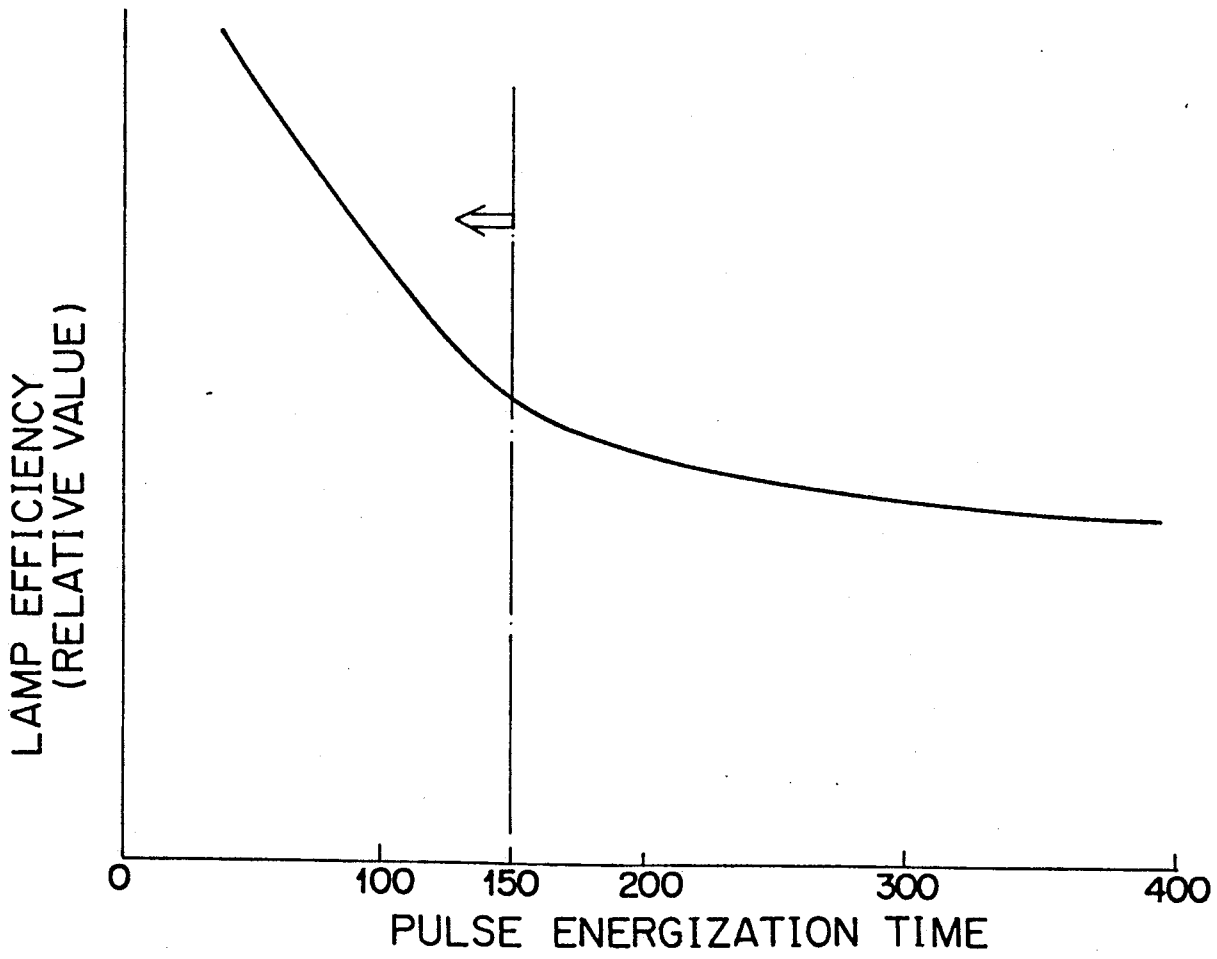
FIG. 10 is a diagram showing a lamp efficiency with respect to an energization time of a pulse commonly when xenon gas, argon gas or krypton gas is used with the device shown in FIG. 7.
Figure 11:
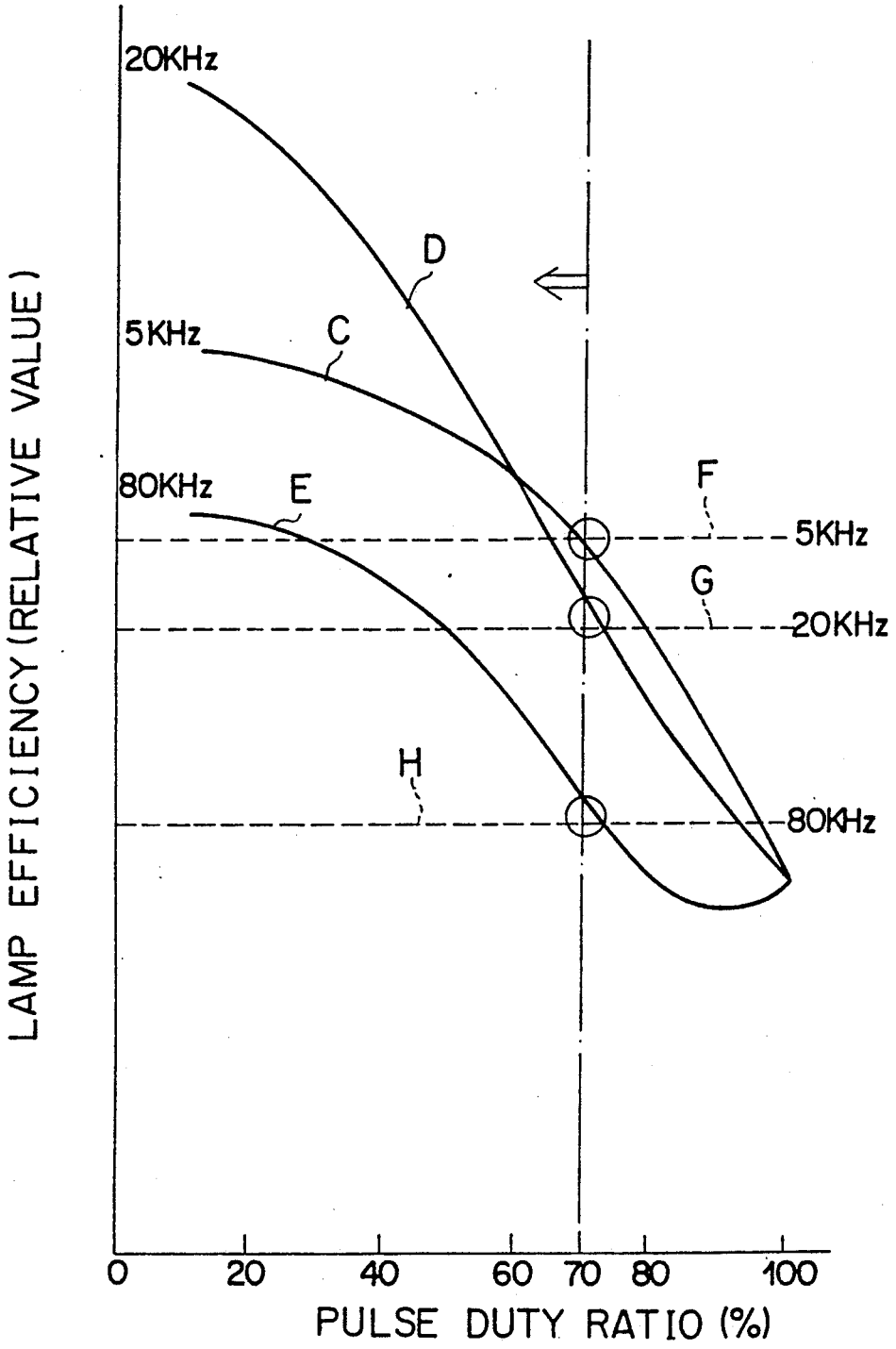
FIG. 11 is a diagram showing a lamp efficiency with respect to a pulse duty ratio when xenon gas is used with the device shown in FIG. 7.

On the other hand, several lamps having diameters ranging from 8 mm to 15.5 mm and a length of 300 mm with xenon gas enclosed therein at a pressure of 30 Torr were produced, and characteristics of the lamps were measured changing the dc pulse lighting conditions variously. Results of such measurement are shown in FIGS. 10 and 11. FIG. 10 shows a relationship between an energization time within a period of a dc pulse and a lamp efficiency while the deenergization time is held fixed to 100 μsec. From FIG. 10, it can be seen that the shorter the pulse energization time, the higher the efficiency, and the effect is particularly remarkable where the pulse energization time is shorter than 150 μsec. FIG. 11 shows relationships between a lamp efficiency and a pulse duty ratio in the case of pulse lighting at frequencies of 5 KHz, 20 KHz and 80 KHz (curves C, D and E).

Further, efficiency values in high frequency ac lighting (sine wave) at frequencies of 5 KHz, 20 KHz and 80 KHz which are used commonly are shown for comparison in FIG. 11 (lines F, G and H). From FIG. 11, it can be seen that the efficiency is raised by decreasing the duty ratio of pulses as compared with that in dc lighting (duty ratio = 100%), and even compared with that in ac lighting at the same frequency, the efficiency is much higher if the pulse duty ratio is made lower than 70%.

Figure 12:
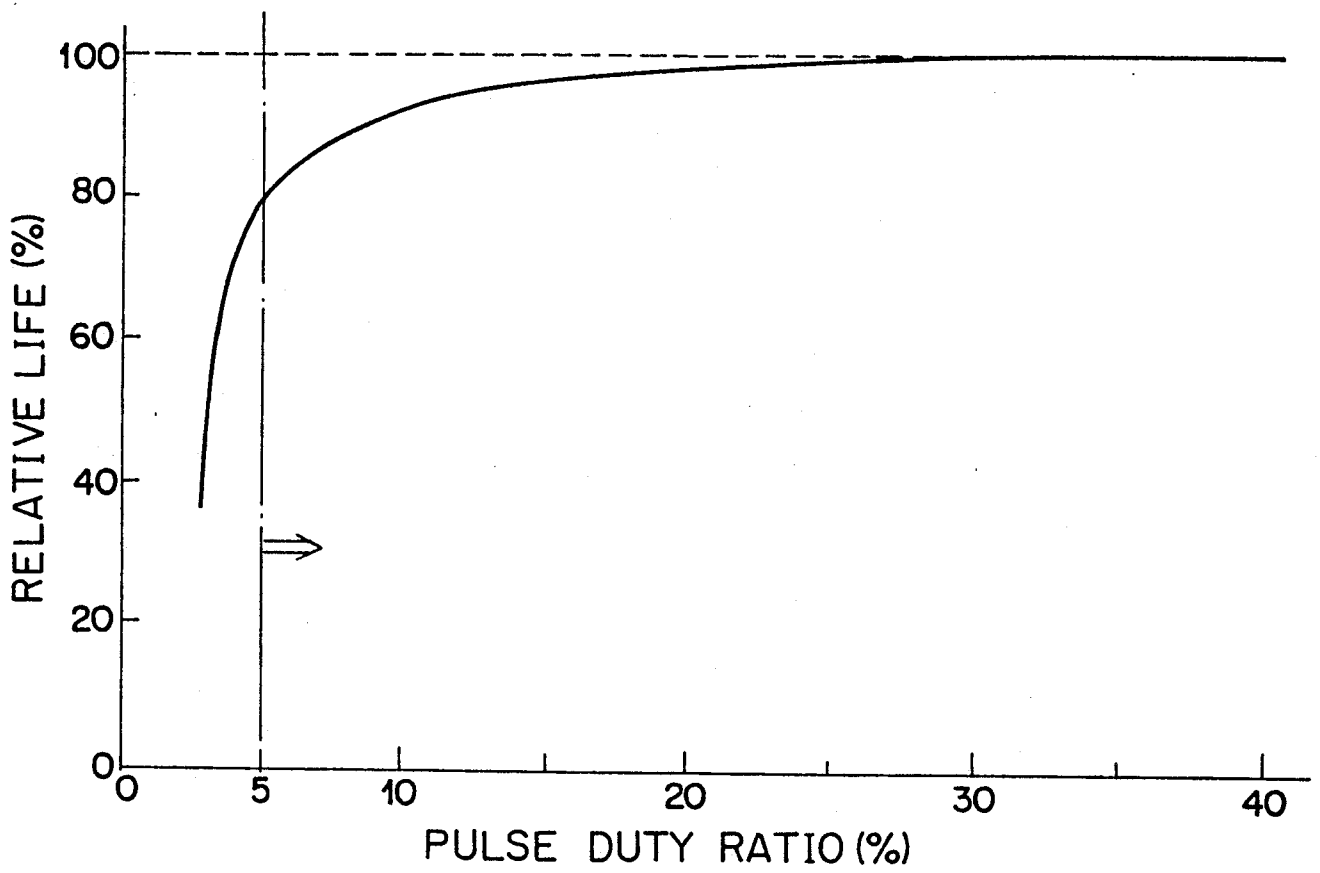
FIG. 12 is a diagram showing a life characteristic with respect to a pulse duty ratio commonly when xenon gas, argon gas or krypton gas is used with the device shown in FIG. 7.

Further, several lamps having diameters ranging from 8 mm to 15.5 mm with xenon gas enclosed therein at pressures of 10 Torr to 200 Torr were produced, and a life test of the lamps was conducted changing the pulse duty ratio while keeping the lamp power fixed. Results are shown in FIG. 12. Here, the terminology "relative life" signifies a ratio of an average life time when the lamp is lit at a varying duty ratio to an average life time when the lamp is lit at a predetermined fixed duty ratio (for example, 40%). From FIG. 12, it can be seen that the relationship between a pulse duty ratio and a relative life presents such a variation that, if the pulse duty ratio is reduced until it comes downs to 5%, the relative life exhibits a little decreasing tendency, and after the pulse duty ratio is reduced beyond 5%, the life drops suddenly. It is presumed that, where the duty ratio is lower than 5%, the pulse peak current of the lamp increases so significantly that wear of the electrodes progresses suddenly. Accordingly, the pulse duty ratio is preferably higher than 5% when the life is taken into consideration.

While the results of the examination wherein xenon gas was used are described above, a similar examination was conducted for characteristics of the lamps wherein argon gas and krypton gas were used. Results of the examination were obtained in a similar manner as described above.

Figure 13:
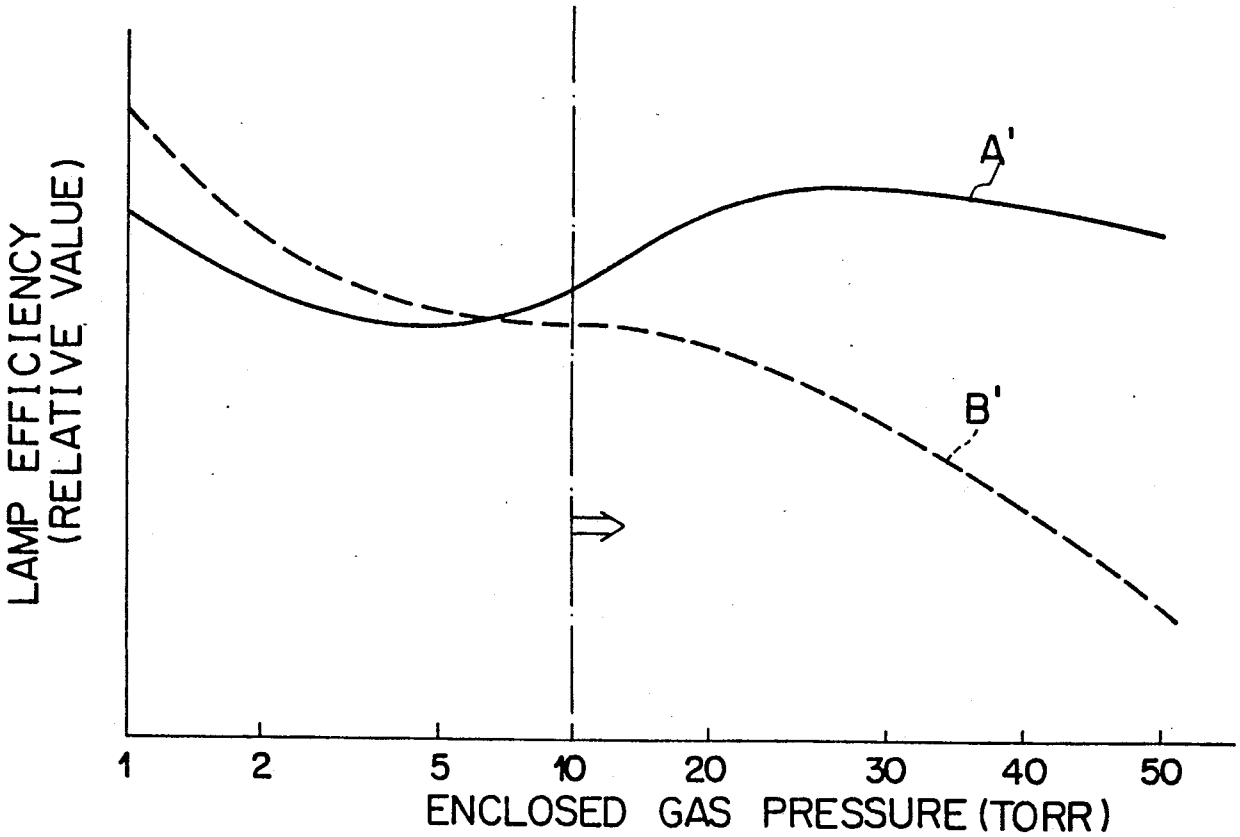
FIG. 13 is a diagram showing a characteristic of a relationship between an enclosed gas pressure and a lamp efficiency when argon gas is used with the device shown in FIG. 7.
Figure 14:
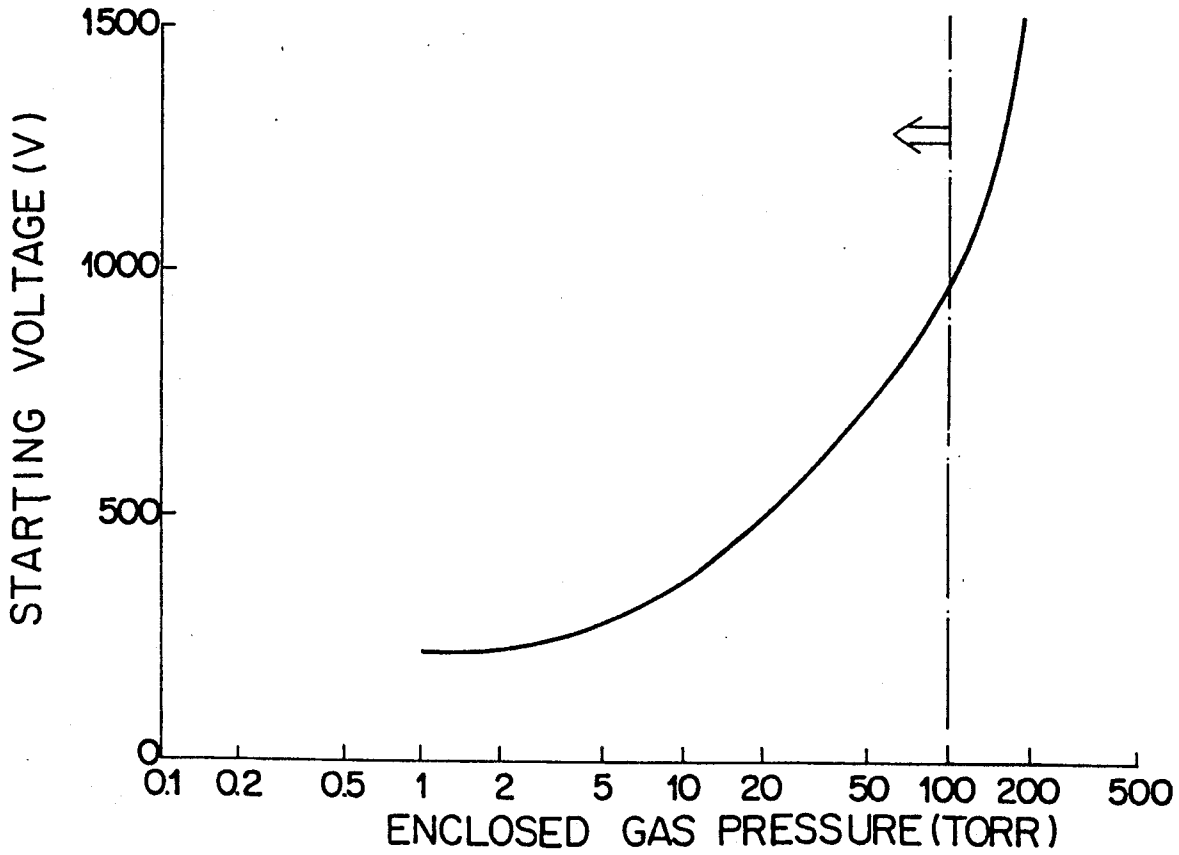
FIG. 14 is a diagram showing a starting voltage characteristic with respect to an enclosed gas pressure when argon gas is used with the device shown in FIG. 7.

In particular, FIG. 13 shows a relationship between a pressure of enclosed argon gas and a lamp efficiency. Referring to FIG. 13, a curve A' indicates the relationship in the case of lighting by rectangular wave dc pulses having a duty ratio of 60% while another curve B' indicates the relationship in the case of ordinary high frequency ac lighting (sine wave) when the frequency is 20 KHz and the electric power is the same. It can be seen from FIG. 13 that there is no significant difference in efficiency between pulse lighting and ac lighting at an enclosed gas pressure lower than 10 Torr, but at an enclosed gas pressure higher than 10 Torr, the efficiency in pulse lighting is higher than that in ac lighting. On the other hand, FIG. 14 shows a relationship between an enclosed gas pressure and a starting voltage, and from FIG. 14, it can be seen that, as the enclosed gas pressure rises, a progressively high voltage is required for starting. Since such rise of the starting voltage is remarkable particularly where the enclosed gas pressure is higher than 100 Torr, the enclosed gas pressure is preferably lower than 100 Torr. Accordingly, from FIGS. 13 and 14, the optimum enclosed argon gas pressure at which the efficiency is higher than that in high frequency lighting and pulse lighting wherein the starting voltage is practical can be attained is higher than 10 Torr but lower than 100 Torr.

Figure 15:
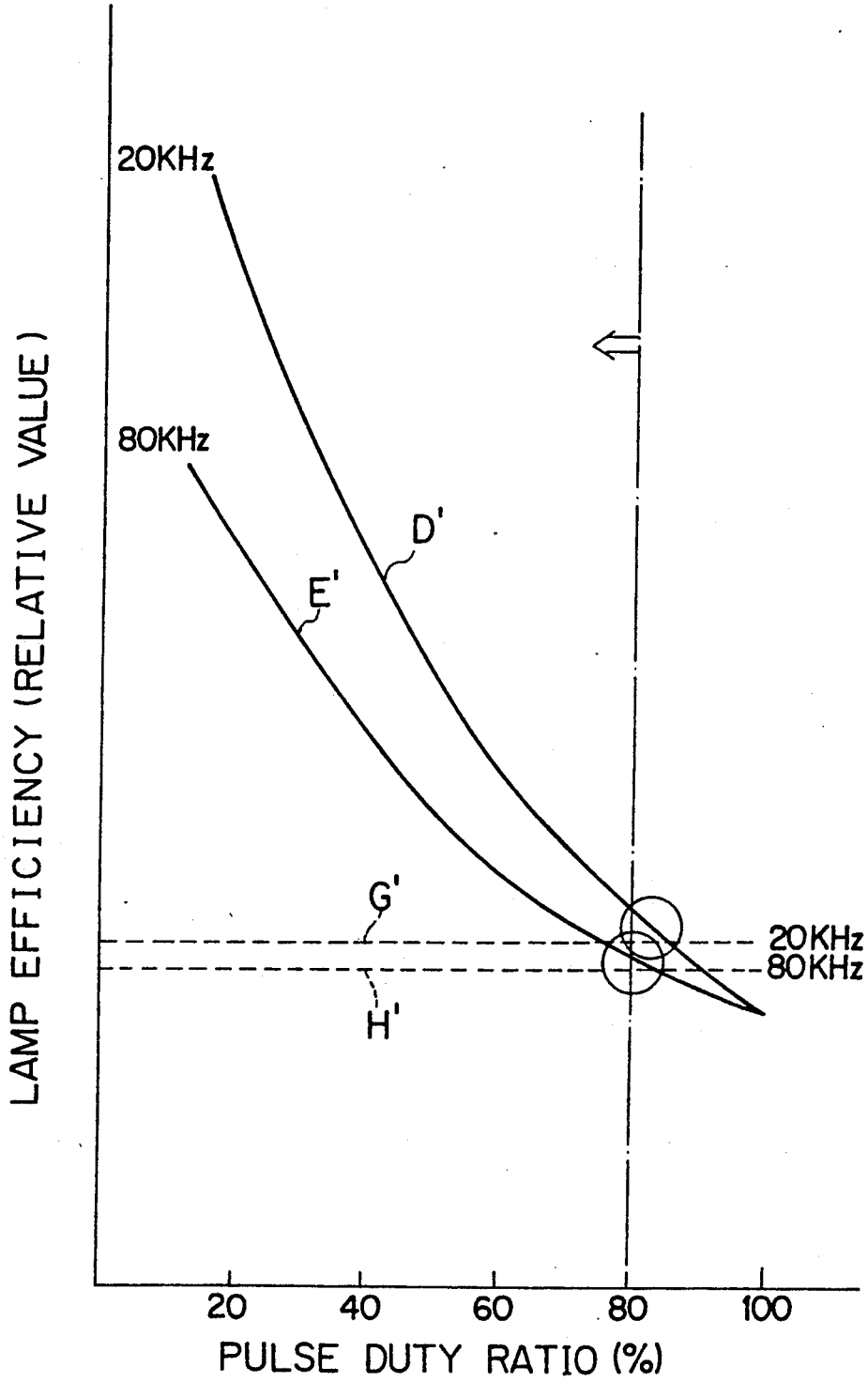
FIG. 15 is a diagram showing a lamp efficiency characteristic with respect to a pulse duty ratio when argon gas is used with the device shown in FIG. 7.

On the other hand, several lamps having diameters ranging from 8 mm to 15.5 mm and a length of 300 mm with argon gas enclosed therein at a pressure of 30 Torr were produced, and characteristics of the lamps were measured changing the dc pulse lighting conditions variously. Results of such measurement are shown in FIGS. 10 and 15. In particular, from FIG. 10, it can be seen, similarly as in the case wherein xenon gas is enclosed as described above, that the lamp efficiency is remarkable particularly where the pulse energization time is shorter than 150 μsec. On the other hand, FIG. 15 shows relationships between a lamp efficiency and a pulse duty ratio in the case of pulse lighting at frequencies of 20 KHz and 80 KHz (curves D' and E').

Further, efficiency values in high frequency ac lighting (sine wave) at frequencies 20 KHz and 80 KHz which are used commonly are shown for comparison in FIG. 15 (lines G' and H'). From FIG. 15, it can be seen that the efficiency is raised by decreasing the duty ratio of pulses as compared with that in dc lighting (duty ratio = 100%), and even compared with that in ac lighting at the same frequency, the efficiency is much higher if the pulse duty ratio is made lower than 80%.

Further, several lamps having diameters ranging from 8 mm to 15.5 mm with argon gas enclosed therein at pressures of 10 Torr to 200 Torr were produced, and a life test of the lamps was conducted changing the pulse duty ratio while keeping the lamp power fixed. Results are the same as those shown in FIG. 12 in which the results where xenon gas was enclosed in the lamp as described above are shown. Accordingly, it can be seen that preferably the pulse duty ratio is also higher than 5% when the life is taken into consideration.

Figure 16:
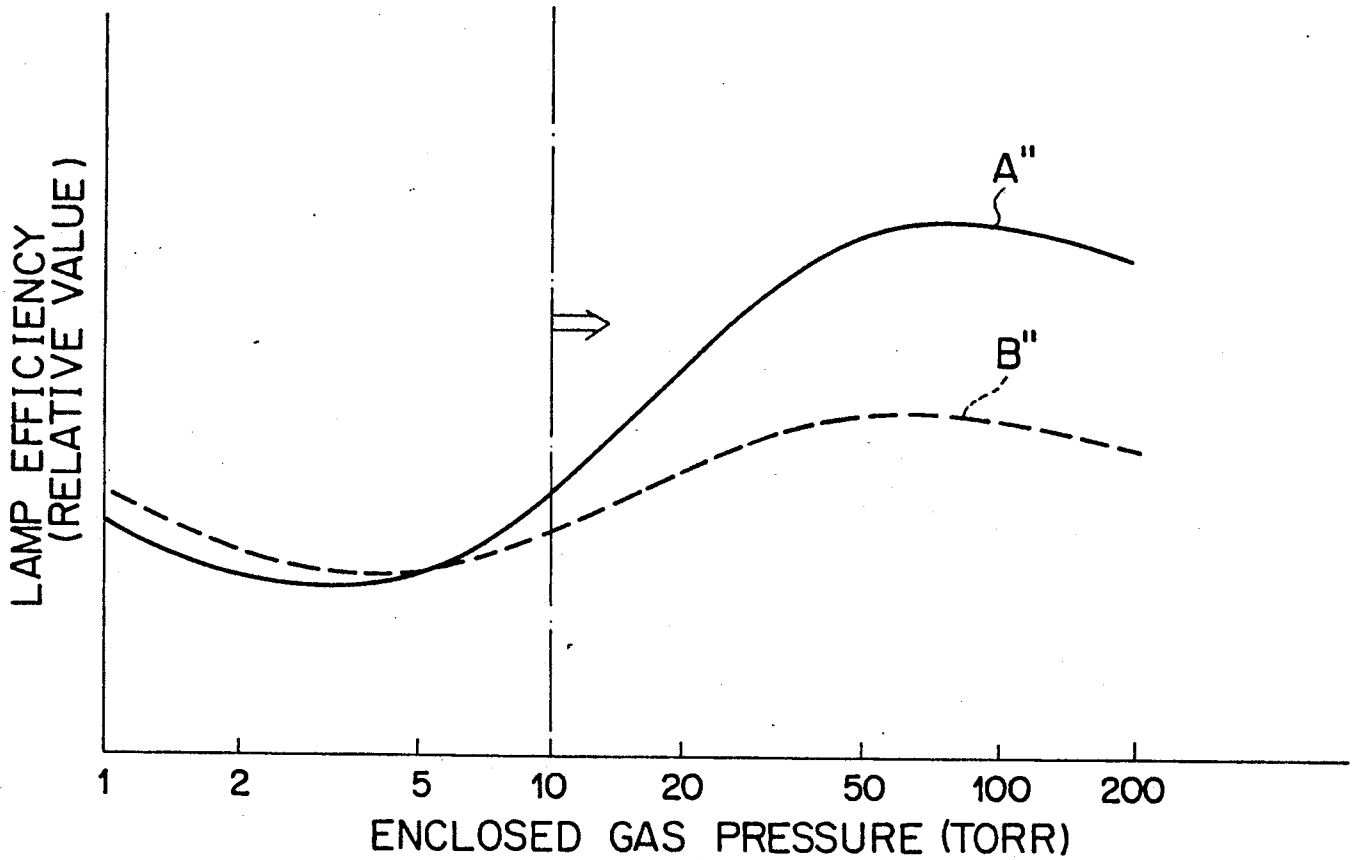
FIG. 16 is a diagram showing a characteristic of a relationship between an enclosed gas pressure and a lamp efficiency when krypton gas is used with the device shown in FIG. 7.

Further, a relationship between an enclosed gas pressure and a lamp efficiency where krypton gas was used is shown in FIG. 16. Referring to FIG. 16, a solid line curve A" indicates the relationship in the case of lighting by rectangular wave dc pulses having a duty ratio of 60% while the curve B" indicates the relationship in the case of ordinary high frequency ac lighting (sine wave) when the frequency is 20 KHz and the electric power is the same. It can be seen from FIG. 16 that there is no significant difference in efficiency between pulse lighting and ac lighting at an enclosed gas pressure lower than 10 Torr, but at an enclosed gas pressure higher than 10 Torr, the efficiency in pulse lighting is higher than that in ac lighting.

Figure 17:
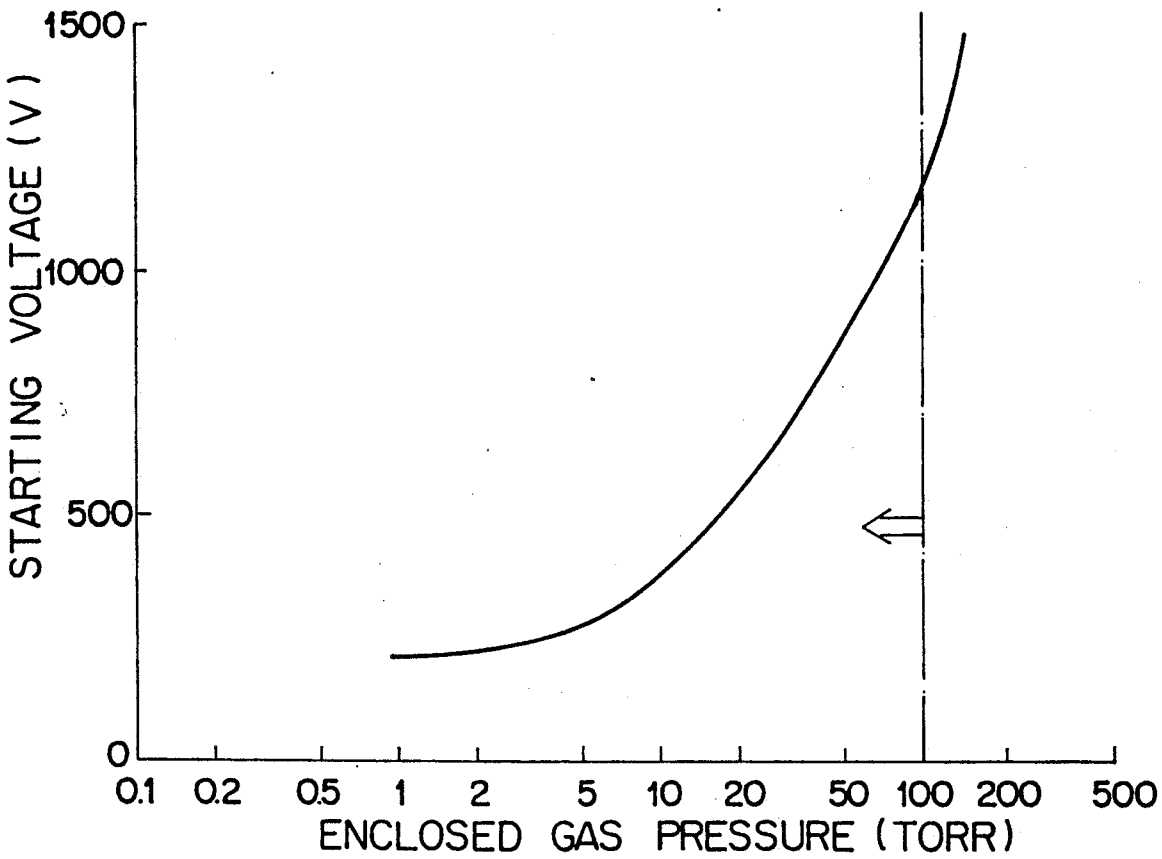
FIG. 17 is a diagram showing a starting voltage characteristic with respect to an enclosed gas pressure when krypton gas is used with the device shown in FIG. 7.

On the other hand, FIG. 17 shows a relationship between an enclosed gas pressure and a starting voltage, and from FIG. 17, it can be seen that, as the enclosed gas pressure of krypton gas rises, a progressively high voltage is required for starting. Since such rise of the starting voltage is remarkable particularly where the enclosed gas pressure is higher than 100 Torr, the enclosed gas pressure is preferably lower than 100 Torr. Accordingly, from FIGS. 16 and 17, the optimum enclosed gas pressure of krypton gas at which the efficiency is higher than that in high frequency lighting and pulse lighting wherein the starting voltage is practical can be attained is higher than 10 Torr but lower than 100 Torr.

Figure 18:
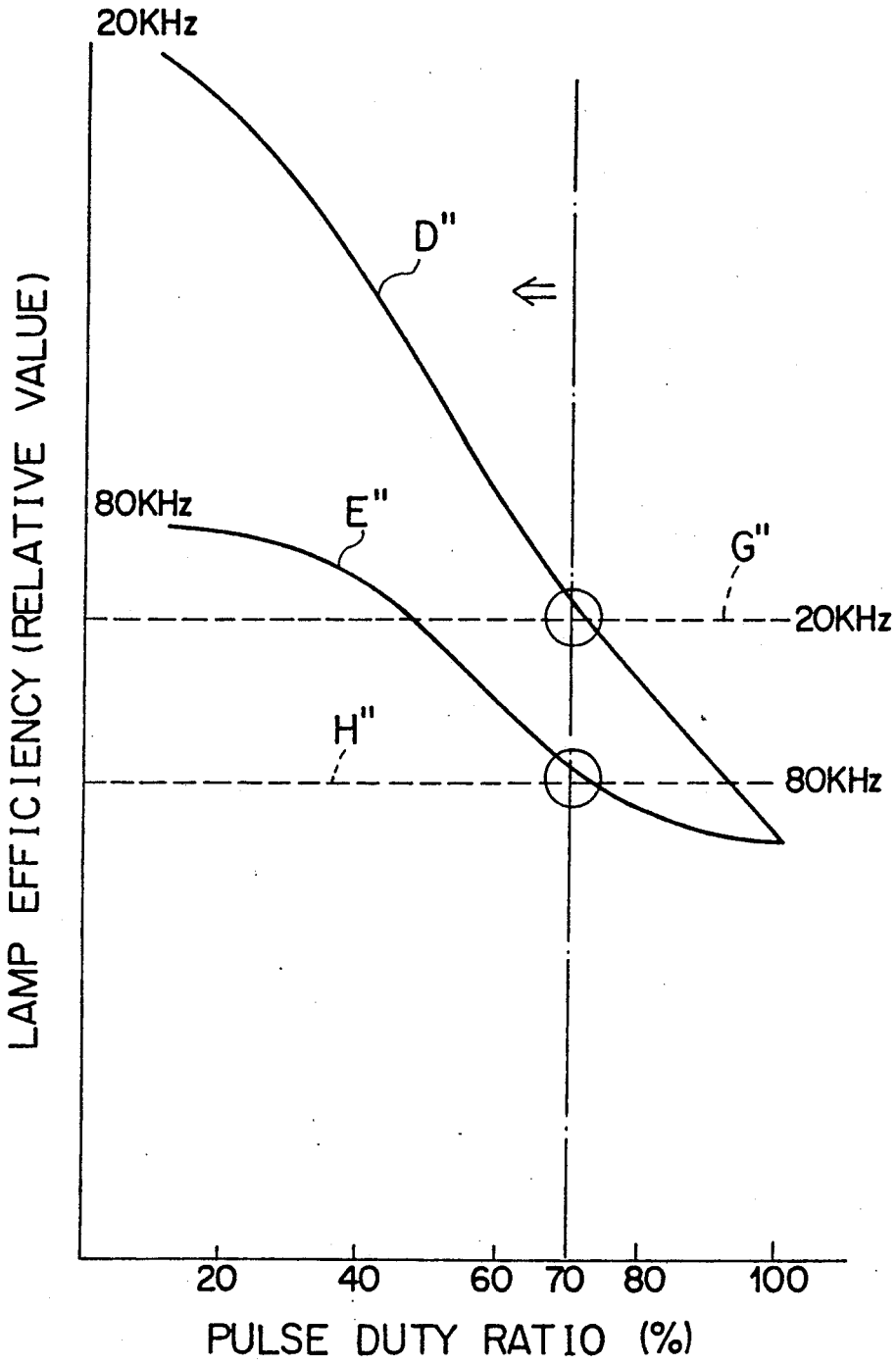
FIG. 18 is a diagram showing a lamp efficiency characteristic with respect to a pulse duty ratio when krypton gas is used with the device shown in FIG. 7.
Figure 20:
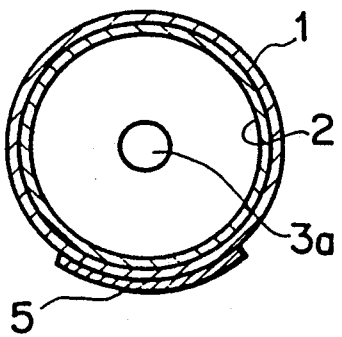
FIG. 20 PRIOR ART
FIG. 20 is a cross sectional view of a lamp of the device shown in FIG. 19.
Figure 19:
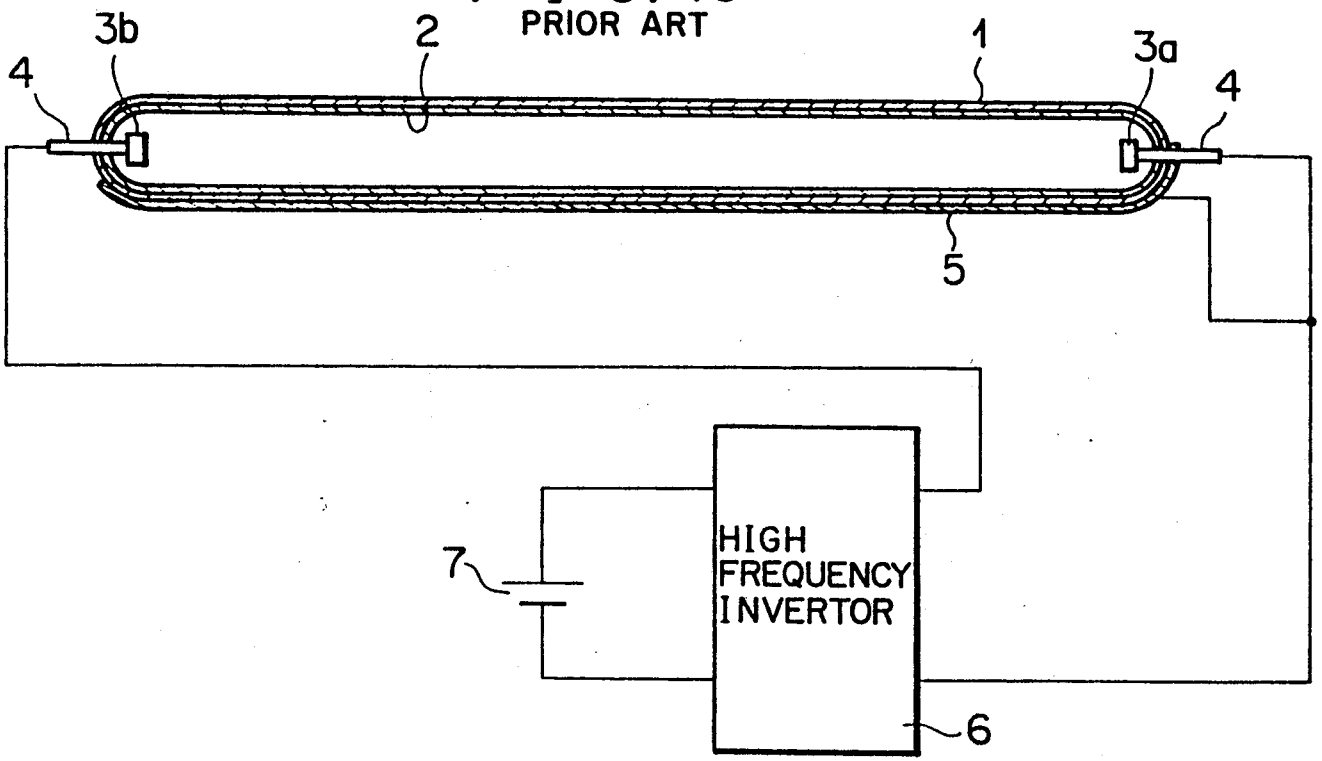
FIG. 19 PRIOR ART
FIG. 19 is a diagrammatic representation showing an entire construction of a conventional rare gas discharge fluorescent lamp device which makes use of a high frequency current.

Further, several lamps were produced with a pressure of enclosed krypton gas of 30 Torr under the same conditions as those where argon gas was used, and characteristics of the lamps were measured changing the dc pulse lighting conditions variously. Results of such measurement are shown in FIGS. 10 and 18. As described hereinabove, from FIG. 10, it can be seen that the lamp efficiency is remarkable particularly where the pulse energization time is shorter than 150 μsec, similarly as in the case where xenon gas or argon gas is enclosed as described hereinabove. Also as described hereinabove, from FIG. 18, the lamp efficiencies in pulse lighting with frequencies of 20 KHz and 80 KHz (D" and E") are much higher if the pulse duty ratio is made lower than 70%, when compared with efficiency values (G" and H") in high frequency ac lighting (sine wave) of the same frequencies which are used commonly.

further, a life test of such lamps with krypton gas enclosed therein was conducted, and results of such life test proved that the pulse duty ratio is preferably higher than 5% as seen in FIG. 12.

In summary, according to the present invention, in case a half-wave rectified voltage is used, where xenon gas is enclosed in a bulb of a lamp of a rare gas discharge fluorescent lamp device, the enclosed gas pressure is set to a value higher than 10 Torr but lower than 200 Torr, and a half-wave rectified voltage having a frequency higher than 4 KHz but lower than 200 KHz is supplied to the bulb to cause the bulb to be lit, but where krypton gas is enclosed, the enclosed gas pressure is set to a value higher than 10 Torr but lower than 100 Torr, and a half-wave rectified voltage having a frequency higher than 5 KHz but lower than 200 KHz is supplied to the bulb to cause the bulb to be lit. Accordingly, there are effects that the rare gas discharge fluorescent lamp device is simplified in construction and can be produced at a reduced cost and that a high lamp efficiency can be obtained. On the other hand, in case a dc rectangular pulse voltage is used, where xenon gas is enclosed in the bulb, the enclosed gas pressure is set to a value higher than 10 Torr but lower than 200 Torr, and the pulse energization time is set to 150 μsec while the duty ratio is set to a value higher than 5% but lower than 70%: where argon gas is enclosed, the enclosed gas pressure is set to a value higher than 10 Torr but lower than 100 Torr, and the pulse energization time is set to 150 μsec while the duty ratio is set to a value higher than 5% but lower than 80%: and where krypton gas is enclosed, the enclosed gas pressure is set to a value higher than 10 Torr but lower than 100 Torr, and the pulse energization time is set to 150 μsec while the duty ratio is set to a value higher than 5% but lower than 70%, and the lamp is caused to be intermittently lit in such conditions as described above. Accordingly, there is an effect that a rare gas discharge fluorescent lamp device of a high brightness and a high efficiency can be obtained without deteriorating the life as compared with that in conventional dc lighting or in ordinary high frequency ac lighting.

What is claimed is:

1. A rare gas discharge fluorescent lamp device, comprising:

a rare gas discharge fluorescent lamp including a bulb having rare gas enclosed therein, a fluorescent layer formed on an inner face of said bulb, and a pair of electrodes located at the opposite ends of said bulb;

a power source for applying a voltage across said electrodes; and pulse voltage forming means connected between said electrodes and said power source for forming a dc pulse voltage from a voltage supplied from said power source, the dc pulse voltage being applied across said electrodes to cause said lamp to be lit;

wherein the frequency of said pulse voltage is higher than 4 KHz but lower than 200 KHz, and said pulse voltage forming means includes a series circuit of a high frequency power source and a current limiting element, and a diode connected in parallel to said series circuit, and forms half-wave rectified pulses.

2. A rare gas discharge fluorescent lamp device as claimed in claim 1, wherein said rare gas is xenon gas enclosed in said bulb at a pressure higher than 10 Torr but lower than 200 Torr.

3. A rare gas discharge fluorescent lamp device as claimed in claim 1, wherein said rare gas is krypton gas enclosed in said bulb at a pressure higher than 10 Torr but lower than 100 Torr.

4. A rare gas discharge fluorescent lamp device as claimed in claim 1, wherein a power source for heating is provided for either one of said electrodes.

5. A rare gas discharge fluorescent lamp device as claimed in claim 1, wherein said current limiting element is a capacitor.

6. A rare gas discharge fluorescent lamp device as claimed in claim 1, wherein said current limiting element is an inductor.

7. A rare gas discharge fluorescent lamp device, comprising:

a rare gas discharge fluorescent lamp including a bulb having a rare gas enclosed therein, a fluorescent layer formed on an inner face of said bulb, and a pair of electrodes located at the opposite ends of said bulb;

a power source for applying a voltage across said electrodes; and pulse voltage forming means connected between said electrodes and said power source for forming a dc pulse voltage from a voltage supplied from said power source, the dc pulse voltage being applied across said electrodes to cause said lamp to be lit; wherein the frequency of said pulse voltage is higher than 4 KHz but lower than 200 KHz, and wherein said pulse voltage forming means includes a series circuit of a dc power source and a current limiting element, and a switching element connected in parallel with said series circuit and connected to a pulse generator to be switched in response to an output of said pulse generator so that DC rectangular pulses are formed thereby.

8. A rare gas discharge fluorescent lamp device as claimed in claim 7, wherein said rare gas is xenon gas enclosed in said bulb at a pressure higher than 10 Torr but lower than 200 Torr, and the duty ratio of the dc rectangular pulses is higher than 5% but lower than 70%.

9. A rare gas discharge fluorescent lamp device as claimed in claim 7, wherein said rare gas is argon gas enclosed in said bulb at a pressure higher than 10 Torr but lower than 100 Torr, and the duty ratio of the dc rectangular pulses is higher than 5% but lower than 80%.

10. A rare gas discharge fluorescent lamp device as claimed in claim 7, wherein said rare gas is krypton gas enclosed in said bulb at a pressure higher than 10 Torr but lower than 100 Torr, and the duty ratio of the dc rectangular pulses is higher than 5% but lower than 70%.

* * * * *

UNITED STATES PATENT AND TRADEMARK OFFICE

CERTIFICATE OF CORRECTION

PATENT NO. : 5,034,661

DATED : July 23, 1991

INVENTOR(S) : Takehiko SAKURAI, et al.

It is certified that error appears in the above-identified patent and that said Letters Patent is hereby corrected as shown below:

Item On the Title page,

[75] Inventors:

The name of the third inventor is changed to:

--Yoshinori ANZAI--

Signed and Sealed this

Twenty-ninth Day of December, 1992

*Attest:*

DOUGLAS B. COMER

*Attesting Officer*

*Acting Commissioner of Patents and Trademarks*